US007222438B2

(12) United States Patent
Jones

(10) Patent No.: US 7,222,438 B2
(45) **Date of Patent: *May 29, 2007**

(54) FABRIC TREATMENT DEVICE

(75) Inventor: David Jones, Bebington (GB)

(73) Assignee: Unilever Home & Personal Care USA, division of Conopco, Inc., Greenwich, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/520,393

(22) PCT Filed: Mar. 11, 2004

(86) PCT No.: PCT/EP2004/002564

§ 371 (c)(1),
(2), (4) Date: Sep. 29, 2005

(87) PCT Pub. No.: WO2004/099489

PCT Pub. Date: Nov. 18, 2004

(65) Prior Publication Data

US 2006/0130356 A1 Jun. 22, 2006

(30) Foreign Application Priority Data

May 6, 2003 (GB) ..... 0310330.6

(51) Int. Cl.
*F26B 19/00* (2006.01)

(52) U.S. Cl. ..... 34/60

(58) Field of Classification Search ..... 34/329, 34/595, 60

See application file for complete search history.

(56) References Cited

U.S. PATENT DOCUMENTS

| | | | | |
|---|---|---|---|---|
| 3,435,537 | A | 4/1969 | Rumsey, Jr. | |
| 3,634,947 | A | 1/1972 | Furgal | |
| 3,701,202 | A | 10/1972 | Compa et al. | |
| 4,014,105 | A * | 3/1977 | Furgal et al. | 34/389 |
| 4,014,432 | A | 3/1977 | Clothier et al. | |
| 4,053,992 | A | 10/1977 | Furgal | |
| 4,254,139 | A | 3/1981 | Hendrickson et al. | |
| 4,379,515 | A | 4/1983 | Towsend | |
| 4,532,722 | A * | 8/1985 | Sax | 34/60 |
| 4,550,676 | A | 11/1985 | Francis | |
| 4,567,675 | A * | 2/1986 | Rennie | 34/60 |

(Continued)

FOREIGN PATENT DOCUMENTS

| | | |
|---|---|---|
| CA | 1 005 204 | 4/1969 |
| EP | 0 361 593 B1 | 9/1989 |
| GB | 1 399 728 | 7/1975 |
| GB | 2 066 309 A | 7/1981 |
| WO | 01/07703 A1 | 2/2001 |
| WO | 01/07704 A1 | 2/2001 |
| WO | 02/33160 A1 | 4/2002 |
| WO | 02/33161 A1 | 4/2002 |
| WO | 03/087463 A1 | 10/2003 |

OTHER PUBLICATIONS

GB Search Report.

*Primary Examiner*—S. Gravini
(74) *Attorney, Agent, or Firm*—Milton L. Honig

(57) ABSTRACT

A device for treating fabrics in a tumble dryer comprising: a reservoir (6) for storing a fabric treatment composition and transfer means (300) to expose fabric treatment composition from the reservoir to airflow generated inside the tumble dryer and/or to directly contact fabrics in the dryer, thereby transferring a portion of the fabric treatment composition into contact with fabrics in the tumble dryer during a tumble drying cycle; characterised in the provision of reservoir charging means (301) comprising one or more charging conduits (60) for directing fabric treatment composition to one or more regions of the transfer means.

13 Claims, 3 Drawing Sheets

U.S. PATENT DOCUMENTS 4,921,131 A 5/1990 Binderbauer et al.
5,020,240 A 6/1991 Lee
5,033,643 A 7/1991 Schumacher
5,072,526 A 12/1991 Hirota et al.
5,176,297 A 1/1993 Mooney et al.
5,843,030 A * 12/1998 Van Der Merwe ..... 604/77
5,966,831 A 10/1999 Anderson
6,352,969 B2 3/2002 Hsu et al.
6,604,297 B2 * 8/2003 Hagemann et al. ..... 34/380
6,609,311 B2 8/2003 Hagemann et al.
7,065,903 B2 * 6/2006 Jones et al. ..... 34/597
2002/0050073 A1 5/2002 Hagemann et al.
2002/0078589 A1 6/2002 Hagemann et al.
2002/0100773 A1 8/2002 Rodd et al.
2004/0025368 A1 * 2/2004 Gerlach et al. ..... 34/418

* cited by examiner

FABRIC TREATMENT DEVICE

BACKGROUND OF THE INVENTION

The present invention relates to a device for treating, fabrics inside a tumble dryer.

In the treatment of fabrics in a tumble dryer it is known to use conditioner dispensing articles, comprising means for attachment of the substrate to the tumble dryer wall. Other proposals, such as for instance disclosed in GB 1,399,728 involve the use of separate means for attaching the conditioning article to the tumble dryer wall.

EP-B-361593 concerns an alternative approach in which a fabric conditioning article comprises a combination of a substrate and a fabric conditioning composition, the substrate being a porous material with a specified void volume and cell count. The article of EP-B-361593 is designed to adhere to the tumble dryer wall.

It is an object of the present invention to provide an improved device suitable for treatment fabrics in a tumble dryer. It is also an object to provide a device with improved delivery of the fabric treatment composition and reduced staining.

SUMMARY OF THE INVENTION

According to the present invention, there is provided a device for treating fabrics in a tumble dryer comprising: a reservoir for storing a fabric treatment composition and transfer means to expose fabric treatment composition from the reservoir to airflow generated inside the tumble drier and/or to directly contact fabrics in the dryer, thereby transferring a portion of the fabric treatment composition into contact with fabrics in the tumble dryer during a tumble drying cycle; characterized in the provision of reservoir charging means comprising one or more charging conduits for directing fabric treatment composition to one or more regions of the transfer means.

With this arrangement the fabric treatment composition can be directed from the reservoir to selected parts of the transfer means and a more comprehensive distribution over the transfer means can be effected. This allows the transfer means to be more effectively charged after initial installation or e.g. for use after a period of storage.

The reservoir charging conduits may be defined by one or more recesses or projections e.g. projecting ribs or an arrangement of corresponding peaks and troughs, wherein the area between ribs/recesses/troughs define conduits or channels which direct the fabric treatment composition to selected parts of the transfer means.

Preferably the reservoir charging means has a common perimeter with the reservoir.

With this arrangement, there is the possibility that the reservoir charging conduits can extend to reach the perimeter of the transfer means for more effective charging.

Preferably the transfer means comprises compressed foam which takes less time to charge (fill up) with composition, and so is effective more quickly after initial installation.

Also, with compression, the foam is stiffened. Stiffening the foam reduces staining which would otherwise result from compression of the foam (and consequential over dosing of the composition) during the tumble drying cycle (as the rotating fabrics impact the foam). Foam compression also reduces the size of the pores within the foam and this enhances the transfer (by capillary action) of fluid composition to the whole foam surface via such pores, by improved capillarity. Otherwise, the fluid can flow under gravity to the lowermost portion/s of the foam and present excessive amounts on the surface, leading to staining.

The compressed foam may be in the form of one or more layers. Preferably the foam layer is compressed prior to fitting in the device. Compression may be by any suitable process, and may use a combination of heat and pressure so as to effect a permanent compression of the foam.

Preferably the compressed foam is polyurethane foam and further preferably it is polyester foam.

Preferably the foam has a compression ratio of 8 or more, i.e. it has been compressed to ⅛ or less than its original thickness.

However, other ratios such as 10, 12, 14 may be used.

The initial (pre-compression) pore size of the foam may be 120 microns or less, preferably 100 or less, further preferably 90 or less, further preferably 80 or less and further preferably 60 or less. Particularly preferred pore sizes are 80 and 60.

Pore size here refers to pores per linear inch or PPI, and can be measured in a number of ways, e.g. by optical microscope.

The transfer means may comprise at least one outer layer of compressed foam and at least one inner flow control member. The latter may be a membrane selected for its fine/precise flow control capability.

Fine/precise flow control materials are often physically delicate, and so with this arrangement, a precise but delicate flow control member can be used for precise dosing of fabric treatment composition, the inner flow control member/s protected by the compressed foam (due to its rigidity).

The transfer means may form part of the reservoir which may be a removable from (for replacement or refilling) or integral with a body portion of the device.

The inner flow control member(s) may, for example, comprise a membrane, or a layer of e.g. semi permeable material/s e.g. polyester, polypropylene, and include Gore-tex™ and Accurel™. or the like or a woven/non-woven membrane which may be, but is not intended to be restricted to a thin skin.

The reservoir may be housed in a body portion and removable therefrom. The transfer means may be on the body, located for fluid connection (by a channel or duct) with the reservoir (when installed). Preferably the reservoir is engageable with the body, e.g. the channel or duct as mentioned above, by a snap-fit connection or interference fit connection, so as to prevent leakage when installed. To this end the body may comprise resilient portions/components (such as the channel or duct) for elastic engagement with the reservoir for a leak-proof fit.

The fluid connection preferably includes an inlet port or channel for receiving a predetermined amount of the composition from the reservoir sufficient for a predetermined number of cycles at a given temperature, time and load size and may further include a charging port or channel or recess situated directly behind the membrane for continuous feed or charging of the flow control members.

The transfer of fabric treatment composition to the fabrics in the tumble drier may be effected solely by airflow generated in the tumble drier. Depending upon the model of the tumble drier and program setting temperatures of up to 100° C. with wet clothes may be generated within the tumble drier, generally in the range 30° C. to 80° C. for most drying cycles (the hot air generated by the heater in the tumble drier may be as high as 150° C., generally 110° C. to 120° C.).

The reservoir may hold sufficient fabric composition for any number of drying cycles and for instance the reservoir may hold sufficient composition for a single cycle. With this arrangement, different compositions could be used for different drying cycles allowing great flexibility for the user.

The reservoir of the device of the invention may alternatively or additionally be capable of holding sufficient fabric treatment composition for a plurality of drying cycles of the tumble drier.

The device according to the invention may comprise a reservoir which is designed to be replaced when the fabric treatment composition is used up. For example, the reservoir may be provided in the form of a disposable plastic container e.g. bottle, carton or collapsible pouch which may have a peelable lid.

Alternatively, the reservoir may be designed to be recharged with a new fabric treatment composition when required The fabric treatment composition may be in the form of a liquid, solid or gel. Where a solid or gel is used, this may be liquid at operating temperatures of the dryer. The composition preferably comprises at least a perfume component and optionally water and may also comprise one or more perfume solubilisers. In this way the composition can act as a freshening composition.

In addition, according to a further aspect of the invention there is provided a kit for the treatment of fabrics in a tumble drying cycle, comprising the combination of the device of the first or second aspect of the invention, together with a fabric treatment composition which may be contained in a reservoir suitable for use with said device.

Instructions for use of the device, including installation/refilling of said reservoir may be included.

In addition, according to the invention there is provided a method of treating fabrics in a tumble dryer during multiple tumble drying cycles using a device according to the first aspect of the invention comprising attaching the device to the inside of a tumble dryer, preferably the door, and carrying out a tumble drying process with fabrics inside the tumble dryer.

Further provided in accordance with the invention is a tumble dryer with a device according to the invention attached therein.

BRIEF DESCRIPTION OF THE DRAWING

Various non-limiting embodiments of the invention will now be more particularly described with reference to the following figures in which.

DETAILED DESCRIPTION

Figure 1:
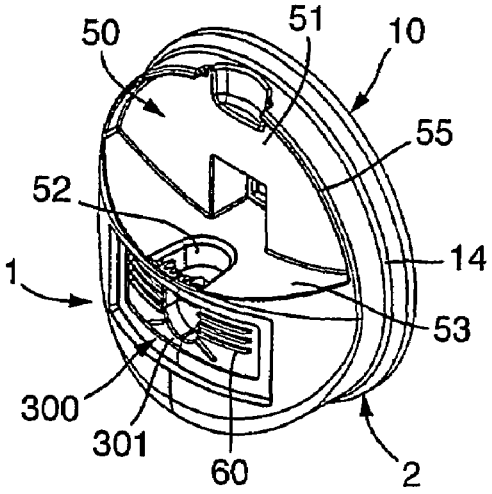
FIG. 1 is a perspective view of a device according to one aspect of the invention (reservoir and transfer means not shown)
Figure 2:
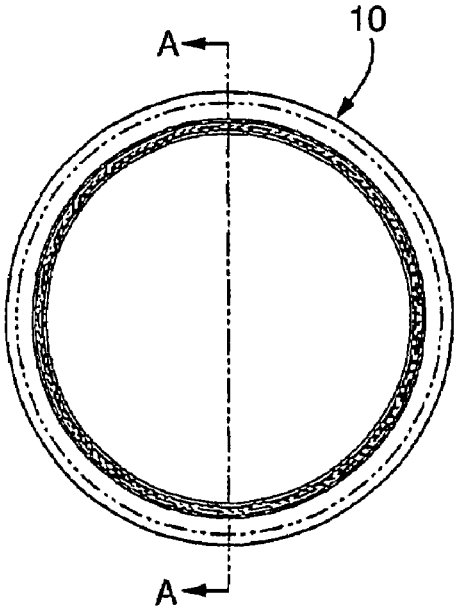
FIG. 2 is a plan view of the flexible portion (no other parts shown)

Similar reference numbers are used throughout the figures to identity common features.

Referring to the drawings, there is illustrated a device 1 (shown orientated upright and viewed in perspective) for treating fabrics in a tumble dryer (not shown) during multiple tumble drying cycles, the device comprising a support member 2 and a reservoir 6 (shown in FIGS. 4*a*–4*g*) for storing fabric treatment composition; transfer means to expose fabric treatment composition from the reservoir 6 to airflow generated inside the tumble drier and/or to directly contact fabrics in the dryer, thereby transferring a portion of the fabric treatment composition into contact with fabrics in the tumble dryer during a tumble drying cycle.

The device includes reservoir charging means 301 comprising one or more charging conduits for directing fabric treatment composition to one or more regions of the transfer means (generally indicated at 300).

The hemispherical dome shape of the device is modified by inclining the portion housing the transfer means 300 outwardly, so that in use (i.e. attached to an upright tumble dryer door or wall) the transfer means 300 is orientated upright.

The transfer means 300 comprises two flow control members (not shown in detail but indicated at 300): an inner delicate but precise flow control member and an outer compressed foam layer. The inner flow control member is a polypropylene membrane with a thickness of 160 microns and a pore size of 0.2 microns. However other thickness/pore size values may be used, the appropriate pore size and thickness of the membrane varying depending on the fabric treatment composition viscosity, and the delivery rate required.

The compressed foam has a compression ratio (or 'firmness') of 8, having been compressed from an initial thickness of 42 mm to a compressed thickness of 6 mm. The foam has an (initial, i.e. pre-compression) pore size (PPI, pores per liner inch) of 80 ppi. The foam is a polyester foam the density of the foam material is 0.383 $g/cm^3$=$kg/m^3$ (=23.9 pounds per cubic foot.).

The foam and membrane are fixed around their perimeters preferably by ultrasonic welds and preferably, to enable a better seal (for the purpose of preventing leaking of the fabric treatment composition), by a substantially continuous weld, to a window frame (not shown but window area indicated at 300 in FIG. 1).

Optionally, the inlet port 52, is integral with the window frame, again, to enable a leak proof system. The manufacture of the framed membrane involves melting upstanding ribs on the frame by ultrasonic welding so as to weld these to the perimeter of the membrane. The framed membrane is attached to the support member 2 (by the ultrasonic welding which is done with the port/frame/membrane in situ in the device body).

The area inside of the welded perimeter provides the effective flow control area that is to say the active part of the flow control members.

In the embodiments shown, the area is 40×27 mm=1080 $mm^2$. Another embodiments (not shown) may have has larger area of 50×27 mm=1350 $mm^2$, or larger still, Such as 80×30=2400 $mm^2$. Preferably the effective part of the transfer means has an area in the range 500–5000 $mm^2$.

Behind the members is a recess of corresponding shape which has a slightly projecting perimeter region for attachment of the frame thereto, so that a gap is defined between the inner member and the recess wall. In this narrow gap approximately 2–3 mm, a small amount of freshener fluid can collect to 'charge' or 'feed' the members continuously without causing leakage's.

The reservoir charging means 301 comprises a recess behind the transfer means 300, and includes a combination of parallel and radially arranged projecting ribs which define reservoir charging conduits (between adjacent ribs) function to deliver fabric treatment composition to all parts, including the periphery of transfer means 300, preventing blocking of any parts of the transfer means. The ribs 60 also function to assist priming or charging of the device quickly (ie. When using the device initially). Alternatively, or additionally the reservoir charging means could include a similar arrangement of recesses to define the charging conduits.

Reservoir 6 is attachable to said support member or device housing 2, the support member 2 including attachment means comprising a strip of repositionable fastener material e.g. hook and loop or mushroom head type e.g. Velcro (not shown). A strip of corresponding repositionable fastener material is also attached to the interior of the dryer for attachment of the support member 2 to the tumble dryer interior, and preferably the door, wherein the support member, includes a flexible skirt 10 which contacts the dryer interior and allow positional adjustment of the device relative to the tumble dryer interior, during attachment by the user.

With this arrangement, the user can positionally adjust the device during attachment to the dryer interior, and consequently achieve more effective attachment. The user can also apply force to the device to ensure attachment and the flexible skirt does not inhibit this. This is particularly advantageous in this embodiment where the device is rigid and this rigidity could, without the presence of the skirt, restrict positional adjustment/application of sufficient force.

The flexible skirt 10 extends around the entire periphery of the device and ensures that when attached, there are no gaps around the periphery. Exclusion of gaps has at least two advantages. The first is that it is less likely that any articles of clothing or parts of articles can become trapped behind the device and pull the device off the door. Secondly, it is less likely that lint can become entrapped behind the device and build up over time.

The support member 2 is a generally hemispherical rigid element with a circular periphery 14 approximately 100 mm in diameter. The skirt 10 has an outer diameter (that is, the diameter which contacts the tumble dryer interior) of 117 mm And is approximately 8 mm deep.

Figure 3:
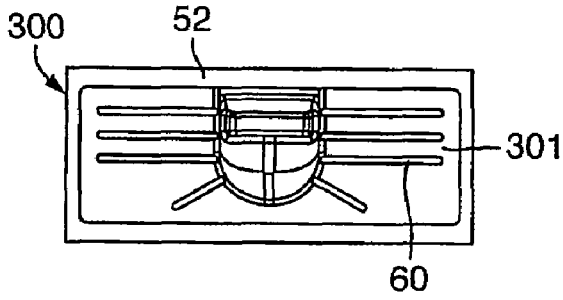
FIG. 3 is a enlarged view of the reservoir charging means of the device of FIG. 1.
Figure 4A:
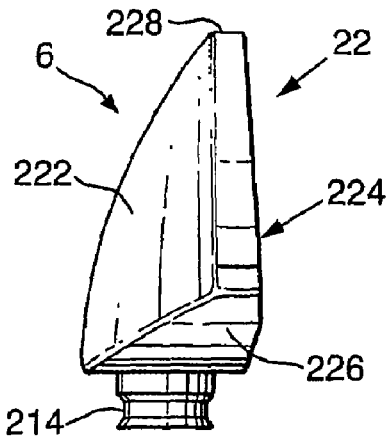
FIGS. 4*a*–4*g* are views of the reservoir for the device of FIG. 1.
Figure 4B:
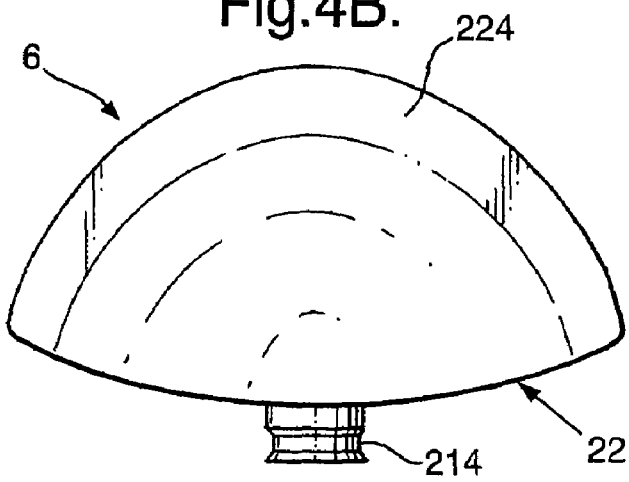
Figure 4C:
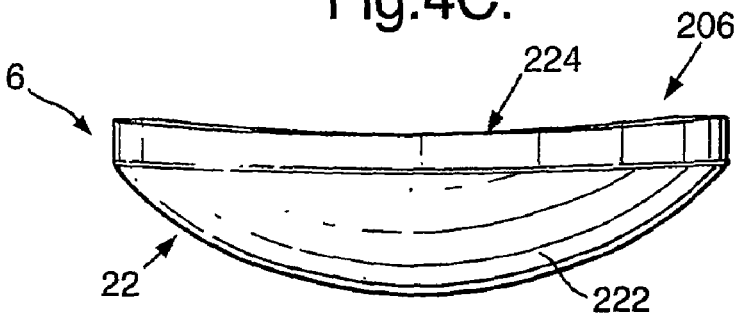
Figure 4D:
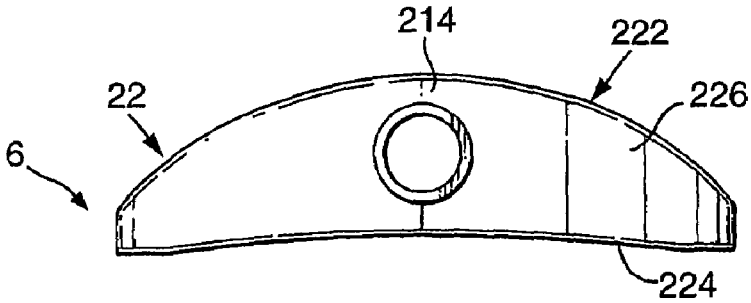
Figure 4E:
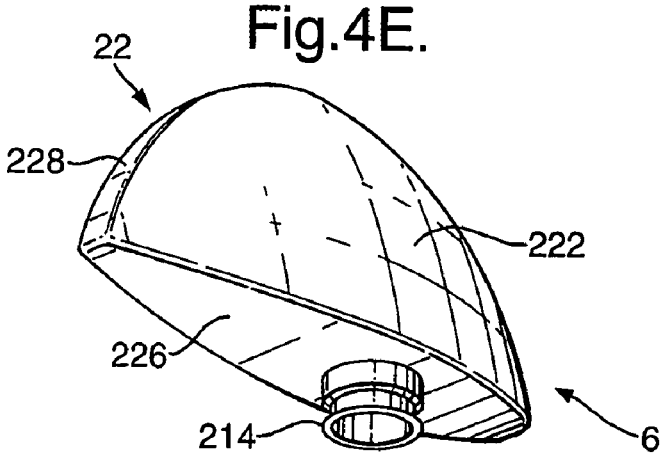
Figure 4F:
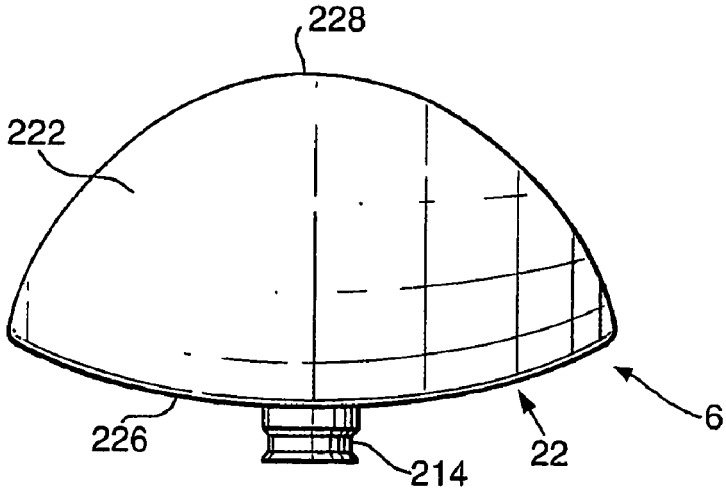
Figure 4G:
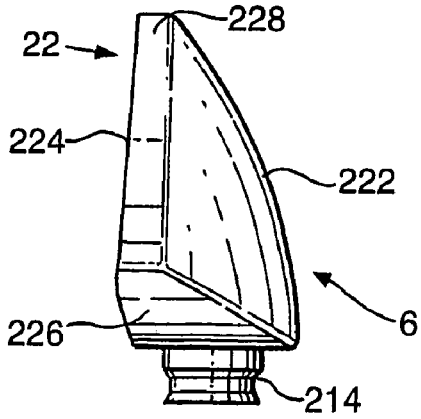

The skirt 10 and periphery are attached bi injection moulding as shown in FIG. 3.

The flexible skirt 10 is formed from a TPE (thermoplastic elastomer).

The attachment means is positioned centrally of the support member 2 and skirt 10, remote from the latter. In this when force is applied to the device in the area of the attachment means it is not necessarily directly applied to the flexible portion/s, allowing optimal positional adjustment and attachment.

The flexible skirt 10 is inclined outwardly, relative to the direction of main component of the force for attachment to allow greater flexing of the perimeter during attachment.

The flexible skirt 10 has a curved profile, wherein the curvature follows in the direction of the above mentioned inclination.

Some modern tumble dryers have one or more small holes in the inside of the door to allow moisture out of the tumble dryer drum to condense in a tray below or vented to the outside of the machine, in this case, a hook or claw attachment on the device is included for supplemental attachment (not shown).

The reservoir 6 comprises a rigid dome shaped body 20 housing a reservoir bottle 22 configured for snap-fit engagement in recess 50 of support member 2. The reservoir recess 50 constitutes a major part of the upper half of the member 2 ('upper' when orientated upright).

The reservoir 6 is attachable to the support member 2 so as to lock into position.

As shown more clearly in FIG. 1, the reservoir body 20 includes a chamber or inlet port 52, having a capacity to hold a predetermined volume of fluid freshener, which is, in this embodiment 1.5 ml and is sufficient for one drying cycle of 1 hour at 60 degrees C. However, the inlet port may have a volume sufficient for any number of cycles. The port 52 is located beneath (when the device is held oriented as shown in FIG. 1—as it would be in use) and in fluid communication with the reservoir recess 50 to allow liquid to enter the port 52 from the reservoir bottle 22 when it is in place in the recess 50.

The rear of the device (not shown) is recessed and also contains a hook for supplemental attachment to the tumble dryer door of e.g. condenser dryers (which have slots or holes in the door or pitted surface). One possible hook shape is shown comprising an elongate arm which is pivotable about a pivot through about 90 degrees, between a storage position in which the hook is enclosed within the rear recess and an attachment position in which it projects from the device. The hook is curved only where it connects with the device—it is straight at the opposite end, as the gentle curve blocks the removal of the machine filter in some machines, so needs to be removed from the design for such machines.

As shown in FIGS. 4*a*–4*g*, the reservoir bottle 22 comprises a polypropylene bottle with body portion and neck portion 214. The body portion is defined by three main generally crescent shaped faces: a front face 222 and a rear face 224 and a shoulder face 226. The front and rear faces 222, 224, extend from opposed edges of the shoulder face 226 and depend therefrom to meet at a common curved edge 228. The radius of curvature of the rear face 224 is less than that of the front face 222.

The reservoir recess 50, has a curved back wall 51, base wall 53 and top wall or lip 55 which correspond in shape with the rear face 222, shoulder face 225 and edge 228 respectively so that the reservoir is retained in the recess by the walls 53, 55, and by the engagement of the neck portion 214 with the port 52. The neck is configured for engagement with the inlet port 52, taking into account any seals: The inlet port 52 may include an annular resilient seal of a thermoplastic elastomer (TPE) to ensure leak proof engagement of the reservoir bottle 22 with the port 52.

The reservoir bottle 22 preferably has a pin-hole (not shown) in an upper region e.g. the edge region or front face or back surface so that as fluid freshener leaves the bottle it can be replaced with air, gradually, so as not to interfere with the gradual flow of the fluid to the membrane. This has the advantage of ensuring consistency in delivery of composition.

Insertion and removal is aided by limited flexibility of the refill bottle 22 and support member 2 such that snap-fit installation and removal can be effected easily.

In use the reservoir is disposed with the neck pointing downwards, engaging the inlet port so that fluid from the reservoir flows, under gravity to the port and then to the members from where it evaporates/transfers in the dryer.

The fabric treatment composition may take any suitable form, for example it may be as described in any of the following embodiments (e.g. solid, liquid, gel at room temperature).

The invention claimed is:

1. A device for treating fabrics in a tumble dryer comprising:

a reservoir for storing a fabric treatment composition;

a foamed material through which the fabric treatment composition is transferred to fabrics in the dryer during a tumble drying cycle; and a plurality of charging conduits communicating with a plurality of regions of the foamed material for directing the fabric treatment composition from the reservoir to the plurality of regions.

2. A device according to claim 1 wherein the charging conduits are defined by one or more projections.

3. A device according to claim 1 wherein the charging conduits are defined by one or more projecting ribs.

4. A device according to claim 1 wherein the charging conduits are defined by an arrangement of corresponding peaks and troughs.

5. A device according to claim 1 wherein the charging conduits are aligned parallel.

6. A device according to claim 1 wherein the charging conduits are defined by a plurality of aligned parallel projections.

7. A device according to claim 1 further comprising an inlet port allowing fabric treatment composition communication between the reservoir and the plurality of charging conduits.

8. A device according to claim 7 wherein the plurality of charging conduits are radially arranged about a center of the inlet port.

9. A device according to claim 1 wherein the plurality of charging conduits comprise curved projections.

10. A device according to claim 1 wherein the foamed material comprises a compressed foam.

11. A device according to claim 10 wherein the compressed foam is a foam with a thickness compressed to ⅛ or less of an initial thickness prior to being placed in the device.

12. A device according to claim 10 wherein the foamed material in a pre-compressed state has a pore size of 120 micron or less.

13. A device according to claim 1 wherein the foamed material comprises a compressed foam and an inner flow control membrane.

* * * * *